US005191381A

United States Patent [19]

Yuan

[11] Patent Number: 5,191,381

[45] Date of Patent: Mar. 2, 1993

[54] PTC CERAMIC HEAT ROLLER FOR FIXING TONER IMAGE

[76] Inventor: Jie Yuan, 524 Linden Rd., State College, Pa. 16801

[21] Appl. No.: 743,675

[22] Filed: Aug. 12, 1991

[51] Int. Cl.[5] ..... G03G 15/20

[52] U.S. Cl. ..... 355/285; 219/216; 219/469; 219/471

[58] Field of Search ..... 355/282, 285; 219/216, 219/469–471, 504, 505, 543, 553; 118/60; 432/60

[56] References Cited

U.S. PATENT DOCUMENTS

| | | | |
|---|---|---|---|
| 4,213,031 | 7/1980 | Färber | 219/469 X |
| 4,266,115 | 5/1981 | Dannatt | 219/216 |
| 4,395,109 | 7/1983 | Nakajima et al. | 219/216 X |
| 4,544,828 | 10/1985 | Shigenobu et al. | 219/216 |
| 4,628,183 | 12/1986 | Satomura | 219/216 |
| 4,730,103 | 3/1988 | Hawkins | 219/505 X |
| 4,791,275 | 12/1988 | Lee et al. | 219/469 |
| 4,810,858 | 3/1989 | Urban et al. | 219/469 |
| 4,813,372 | 3/1989 | Kogure et al. | 118/60 |
| 4,899,032 | 2/1990 | Schwarzl et al. | 219/505 X |
| 4,905,051 | 2/1990 | Satoh et al. | 355/282 X |
| 4,949,130 | 8/1990 | Torino | 355/282 |
| 4,949,131 | 8/1990 | Ito | 355/282 |
| 4,965,640 | 10/1990 | Watarai et al. | 355/282 X |

*Primary Examiner*—A. T. Grimley
*Assistant Examiner*—William J. Royer

[57] ABSTRACT

A heating device, which can be used in the fixing unit of an image forming apparatus, such as an electrophotographic copying or printing machine, for fixing a toner image on a sheet of image transferring medium, includes a ceramic heat roller whose body is formed of a resistor material having positive temperature coefficient of resistance (PTC), capable of self-heating and self-regulating the temperature.

1 Claim, 6 Drawing Sheets

PTC CERAMIC HEAT ROLLER FOR FIXING TONER IMAGE

BACKGROUND OF THE INVENTION

1. Field of the Invention

This invention relates to an image forming apparatus employing toner to form a toner image on a sheet. More particularly, this invention relates to the fixing means of the image forming apparatus, which includes rollers for pinching and heating a sheet carrying a toner image thereon so as to fix the toner image on the sheet.

2. Description of the Related Art

In an image forming apparatus, a sheet carrying a toner image formed onto it by the well-known technique passes thought a fixing unit, which comprises a pair of rollers, of which at least one is a heat roller, to have the toner particles melted and bonded onto the sheet. The other roller in the fixing unit is usually a backup roller, such as those in the embodiments disclosed in the following U.S. patents: U.S. Pat. No. 4,949,130 to Torino; U.S. Pat. No. 4,949,131 to Ito; and U.S. Pat. No. 4,965,640 to Watarai et al. An alternative design includes two heat rollers, such as the embodiment described in U.S. Pat. No. 4,905,051 to Satoh et al. The rollers are pressed transversely against each other so that the sheet is pressed tightly and evenly against the heat roller to have the toner particles melted and bonded on the sheet. It is required that the temperature of the heat roller should be kept in a predetermined temperature range. If the temperature is too low, the toner particles may not bond strongly enough on the sheet after the sheet is processed by the fixing unit. If the temperature is too high, the over-melted toner may smear on the sheet, therefore lowering the resolution of the image.

In conventional image forming apparatus, the heat roller is heated by a heat generating means inside the hollow roller. The heat generating means is usually a heat lamp, which is employed in the embodiments described in all the above mentioned U.S. patents. The temperature of the heat roller is usually controlled by bimetallic thermoswitches, such as in a Digital LN-03 laser printer, or an Apple Personal LaserWriter LS printer; or by an electronic circuitry with a thermistor sensor, such as the designs disclosed in U.S. Pat. No. 4,905,051 to Satoh et al., and in U.S. Pat. No. 4,949,131 to Ito.

There are several shortcomings for the conventional means of heating the heat roller and controlling the temperature. First, the heat roller is heated indirectly by the heating means inside, but not in contact with, the roller. Because the thermal inertia is rather large and the heat is transferred mainly by radiation which is not very efficient, it takes some time to raise the temperature of the outer surface of the heat roller to a predetermined temperature, which typically ranges from 160° C. to 190° C. Therefore the fixing unit of an image forming apparatus could not become operational immediately after the power is turned on. For this reason, the heat roller is usually kept hot even during the time period when the apparatus does not process any sheets. A timer circuitry is employed in some of the apparatuses that turns off the heating circuit after a period of inactivity to reduce the waste of energy. However the user will have to activate the heating circuit and wait for another heat-up period to have any sheets processed by the apparatus. Second, when the temperature is controlled by a bimetallic thermoswitch, overheating and underheating can occur during the on/off cycles of the circuit. The fluctuation of the temperature affects the quality of the fixed toner images. Third, the useful life of such bimetallic thermoswitch is limited because of the wear of the contacts. Replacing such thermoswitch usually requires professional service, making the maintenance of the image forming apparatus very expensive. Fourth, the wear of the contacts of the thermoswitch leads to a deviation of the activation temperature of the thermoswitch, therefore a deviation of the temperature of the roller. Sophisticated electronic circuitry with a temperature sensor can control the temperature much more accurately and consistently by continuous feedback process, and will not wear because there are no mechanical contacts in the circuit. But the cost of such control circuitry is very high, therefore these circuitries are employed only in some expensive models of the image forming apparatuses.

It is known that ceramic PTC (positive temperature coefficient of resistance) resistors can be used as electrical heating elements, such as in the applications disclosed in U.S. Pat. No. 4,899,032 to Schwarzl et al., for heating flooring media; and in U.S. Pat. No. 4,213,031 to Farber, for welding thermoplastic foils. A ceramic PTC resistor consists of polycrystalline ceramic materials having the characteristics of semiconductivity and ferroelectricity. The resistance of the materials does not change significantly with the increase of the temperature of the materials (hereafter referred to as the Temperature) until the Temperature reaches a characteristic value, which is often referred to as the Curie temperature. Above the Curie temperature, the resistance of the materials increases with the Temperature very dramatically, reaching $10^2$ to $10^9$ times higher than its value at room temperature over a narrow temperature range according to Kuwabara (in Advances in Ceramics, Vol. 7, American Ceramic Society, 1983, pages 128–145) and Holmes et al (in Advances in Ceramics, Vol. 7, American Ceramic Society, 1983, pages 146–155) in their published research works. FIG. 1 schematically shows a typical change of resistance of a ceramic PTC resistor with respect to the Temperature. The resistance, which is 10 ohm at room temperature, becomes 100,000 ohm above the Curie temperature, $T_c$, corresponding to 10,000 times of the value at room temperature, which is still a moderate magnitude for this kind of PTC ceramic materials. This resistance change results in a change of heating power from 1440 watts to 0.144 watts with an electric power supply of constant 120 volt. With minimal heat dissipation, the Temperature will decrease quickly. When the Temperature decreases to lower than the operating temperature, there will be steep resistance decrease and heating power increase, resulting in a quick increase in temperature. This process automatically reaches an equilibrium state when the amount of heat dissipated is in balance with the amount of heat generated, corresponding to a resistance between 10 ohm and 100,000 ohm and a temperature between the Curie temperature, $T_c$, and the run-away temperature, $T_r$, that is, a point on the steeply rising slope of the curve in FIG. 1. PTC ceramic heating elements are usually designed in such a way that the heating rate at temperatures lower than Curie temperature is many times higher than the heat dissipation rate so that the Temperature can rise to and stay "locked in" at the Curie temperature a few seconds after the power-on.

The Curie temperature of a PTC ceramic material can be adjusted by changing the composition of the material before the heating element is made and will remain unchanged during operation of the heating element. Resistor materials with Curie temperatures as high as 320° C., as low as −50° C., can be readily obtained this way by those skilled in the art according to Schwarzl et al. in their U.S. Pat. No. 4,899,032 and Hawkins in his U.S. Pat. No. 4,730,103.

SUMMARY OF THE INVENTION

It is an object of the present invention to provide a self-heating means for the heat roller which can raise the surface temperature to a predetermined value within a few seconds upon the power-on so that the fixing unit of the image forming apparatus can become operational immediately. This not only increases the operational efficiency of the apparatus, but also assures that energy can be saved by making it unnecessary to keep the roller hot during the inactive period of the image forming apparatus while maintaining the high operation efficiency of the apparatus.

It is another object of the present invention to provide a heat roller which can perform three functions: the image fixing heat roller, the heat generating means, and the temperature control means. Since the temperature is regulated by the heat roller itself, this invention can greatly simplify the designing and manufacturing processes for the fixing unit of image forming apparatus, and increase the reliability of the apparatus significantly because the temperature regulating process does not depend on thermoswitches in the electric circuitry.

In accomplishing the objects, there is provided a ceramic roller body formed of a resistor material having a positive temperature coefficient of resistivity. The body is provided with electrically conductive means disposed upon the resistor body for conducting current from the opposite sides of an electric power supply to the opposite sides of the resistor body. A layer of electrically insulative, thermally conductive material is disposed upon the outer surface of the roller to insulate the sheet being processed from electrical contact with the conductive means on the body of the roller. There is provided mechanical means of supporting and rotating the roller during the operation of the image forming apparatus.

DETAILED DESCRIPTION OF THE INVENTION

Figure 2:
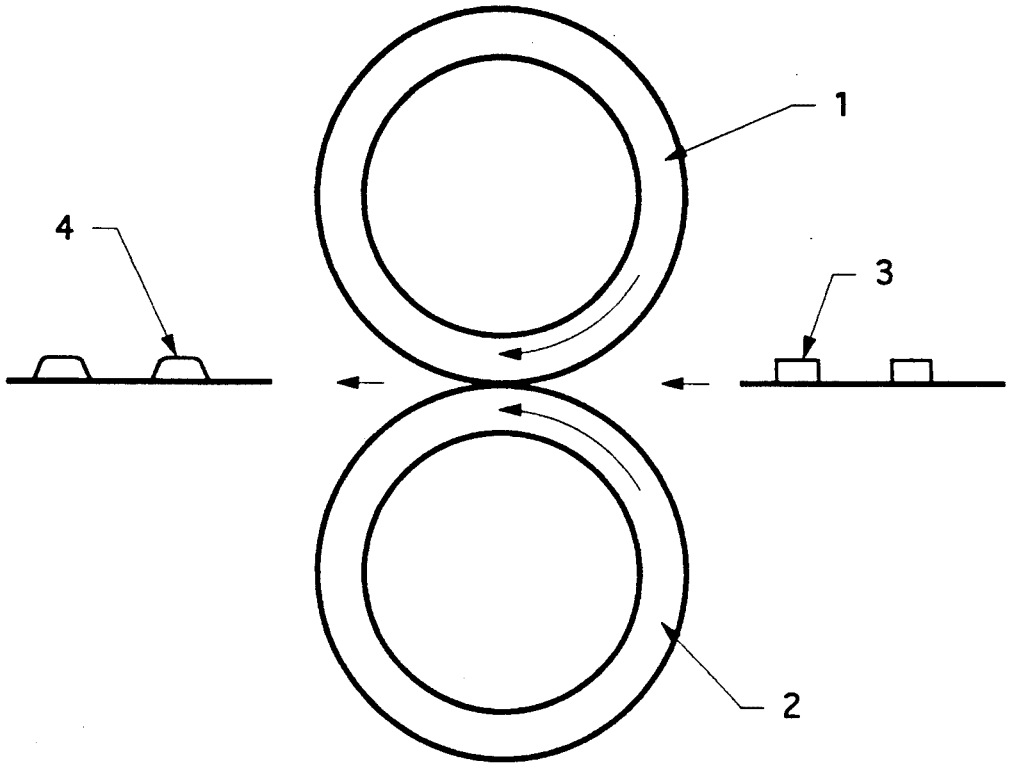
FIG. 2 is a schematic view of a toner image fixing process with at least one of the rollers being hot.

The present invention is for heating and pressing a sheet and fixing the toner image thereon in an image forming apparatus. FIG. 2 schematically shows such a toner image fixing process. A sheet of image transferring medium with unfixed toner 3 thereon passes the transversely compressed rollers 1 and 2, of which at least one is heated, such as roller 1 in FIG. 2. After the sheet passes through the rollers, the toner 4 is melted and bonded onto the sheet. The backup roller in an embodiment with one heat roller is usually formed of elastic materials, such a rubber material, on a metal substrate of round, elongated shape. In an alternative embodiment with two hot rollers (not shown), the two rollers may be formed of same materials and shape or different ones.

In the present invention the heat roller is formed of a ceramic resistor material having positive temperature coefficient of resistance (PTC), which serves not only as the roller for fixing toner image, but also as the heating element and the temperature control. The Curie temperature of the PTC ceramic materials for this heat roller is designed to be at or lower than that of the operating temperature of the roller required by the properties of the toner. Therefore the electrical resistance rises steeply in the range of the operating temperature of the roller with respect to the increase of the Temperature, resulting in a drastic decrease of heating power. Because the ceramic heat roller heats itself, the thermal inertia is much lower than conventional indirect heating means, therefore the heat-up time can become very short. The fixing unit of image forming apparatus can become operational immediately after the power is turned on. The instant readiness of the heat roller is advantageous over conventional heating means in several ways. First, the operation efficiency of the image forming apparatus is higher because it does not have to wait for the fixing unit to get ready either at the power on of the apparatus or after a long period of inactivity. Second, energy waste can be reduced because it is unnecessary to keep the roller at the operational temperature when the apparatus is not actively producing sheets with toner images. Third, the temperature self-regulating function of PTC ceramic roller eliminates the need for a means of temperature control, such as bimetallic thermoswitch or electronic feedback circuitry, therefore reducing the costs in designing, manufacturing and maintaining the apparatus. Fourth, the elimination of bimetallic thermoswitch can also substantially improve the reliability and consistence of performance of the fixing unit.

Figure 3:
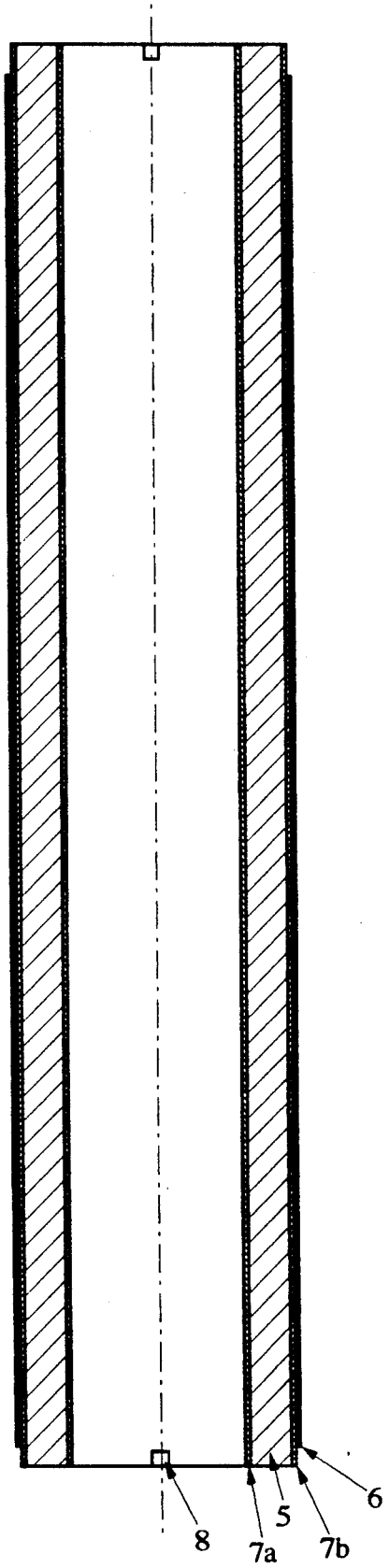
FIG. 3 illustrates a cross-sectional view of one design of the ceramic heat roller.

FIG. 3 illustrates the cross-sectional view of one design of the ceramic heat roller. The ceramic body 5 of the roller is a hollow tube, formed of a ceramic resistor material having positive temperature coefficient of resistance (PTC), with Curie temperature at or lower than the operating temperature of the roller. Electrically conductive means 7*a* and 7*b* are disposed upon the inner surface and outer surface of the ceramic body. An insulating layer 6, which is formed of an electrically insulative and thermally conductive material, capable of withstanding the heat and wear during the operation of the heat roller, preferably a thermoplastic material having a break-down temperature in excess of the particular operating temperature of the roller, is disposed upon the electrically conductive means 7*b* on the outer surface of the roller to keep the sheet being processed from direct contact with the electrically conductive means 7*b*. The roller has a structure 8 on at least one of the ends that can provide means of transmitting rotational driving force to the roller during operation.

Figure 4A:
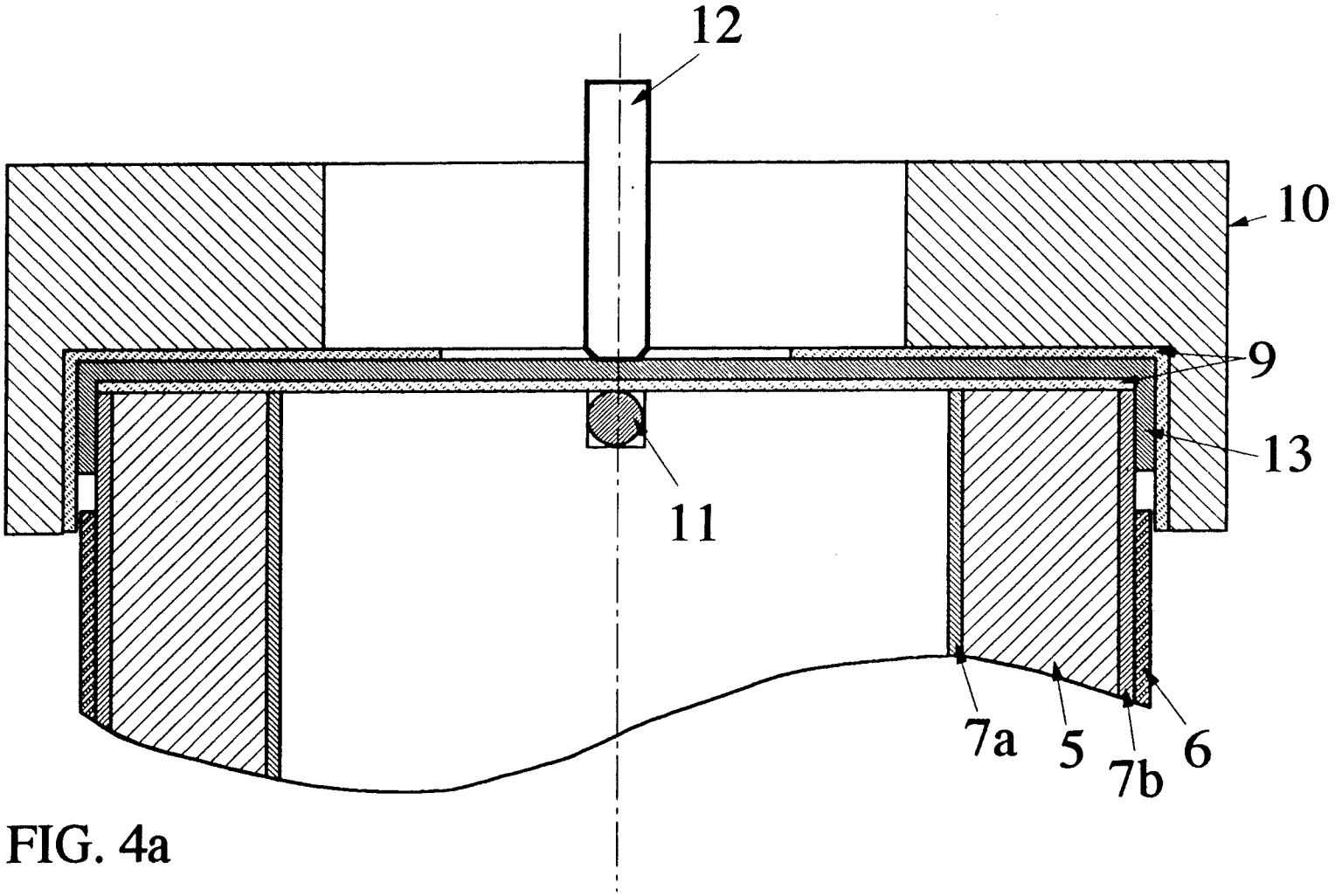
FIG. 4*a*–4*c* are cross-sectional views of the embodiment of the end assemblies of the heat roller.
Figure 4B:
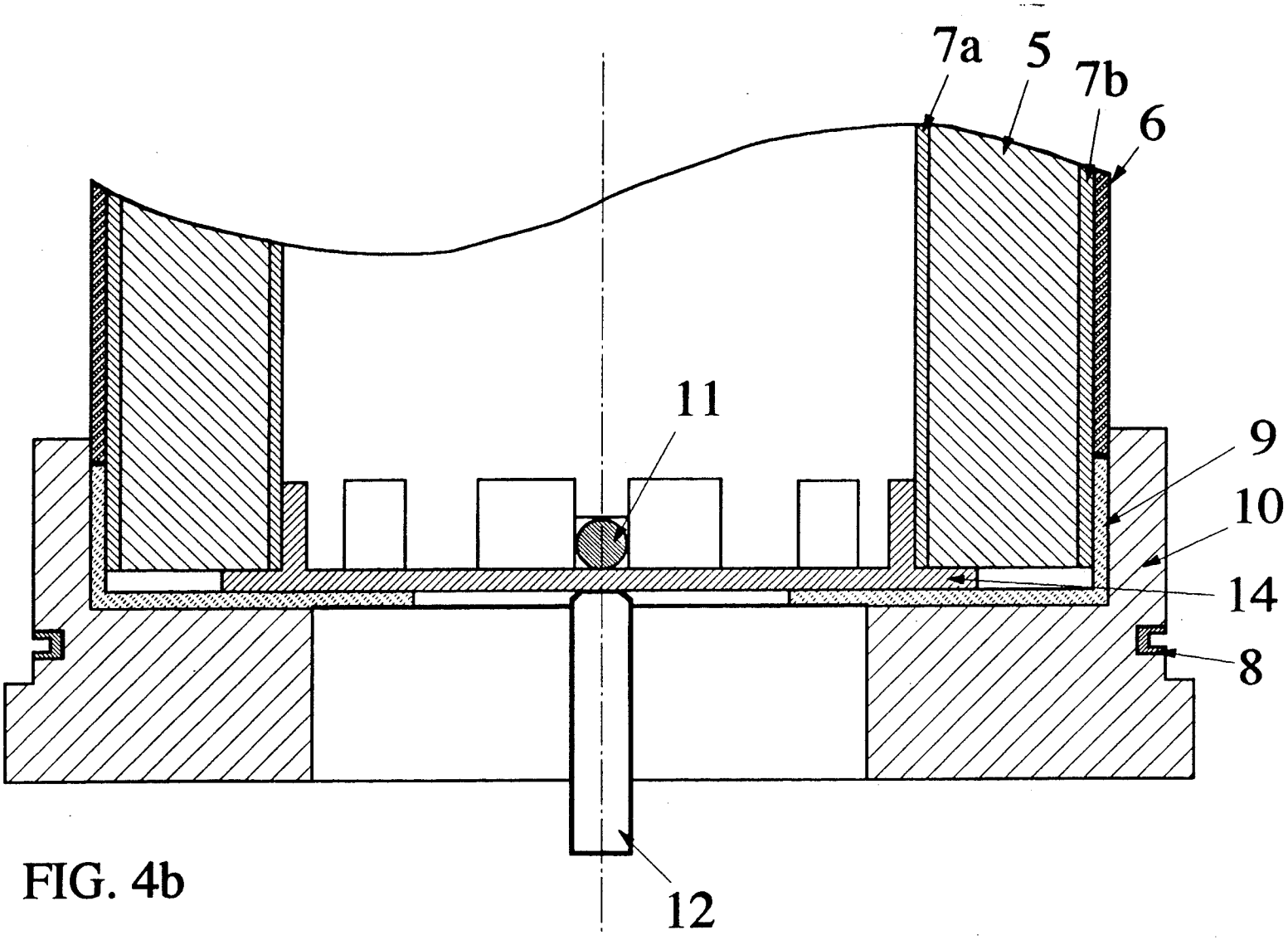
Figure 4C:
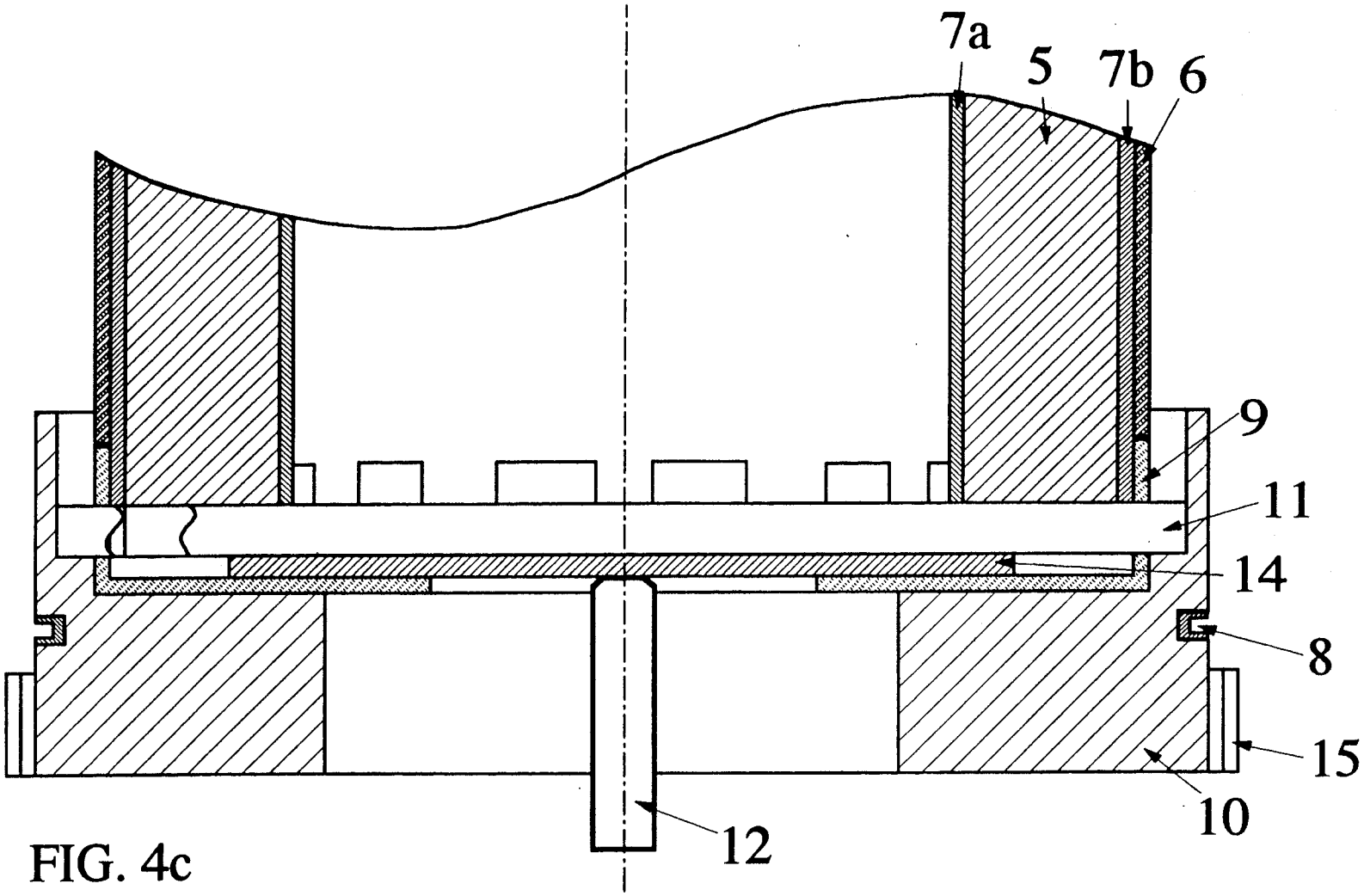

FIG. 4*a* and FIG. 4*b* are the end assemblies of a preferred embodiment. Electrical connections to the electric power supply are accomplished by contacts 12 pressed by springs (not shown) against the centers of the electrically conductive members 13 and 14 in the end assemblies. The contacts, which are electrically conductive and usually formed of carbon, are then connected to the opposite ends of electric power supply (not shown), which usually has a fixed voltage. On one end of the roller, electrically conductive member 13 is in contact with the electrically conductive means *7b* on the outer surface of the roller. On the other end of the roller, similar electrical connection is made with the conductive means *7a* on the inner surface of the roller by conductive member 14. Electrical insulating members 9 are provided between the capping blocks 10 and the conductive members 13 and 14 if the capping blocks are not formed of electrically insulative materials. Insulating member 9 is also inserted between the conductive member 13 and the conductive means *7a* on the inner surface at the end of the roller (FIG. 4*a*) to prevent short circuit. Mechanical support and rotational driving means for the roller are provided by the capping blocks 10, which are formed with structures thereon for bearings and gears (not shown). A pin 11, which is formed of electrically insulative material, preferably a ceramic material, is provided for transmitting rotational driving force from the capping block 10 to the roller body 5 via the structure 8 on the roller body 5. FIG. 4*c* show the cross-sectional view of the same end assembly as in FIG. 4*b* at 90° angle to illustrate the position of the pin 11, relative to the body of the roller 5 and the capping block 10.

Figure 1:
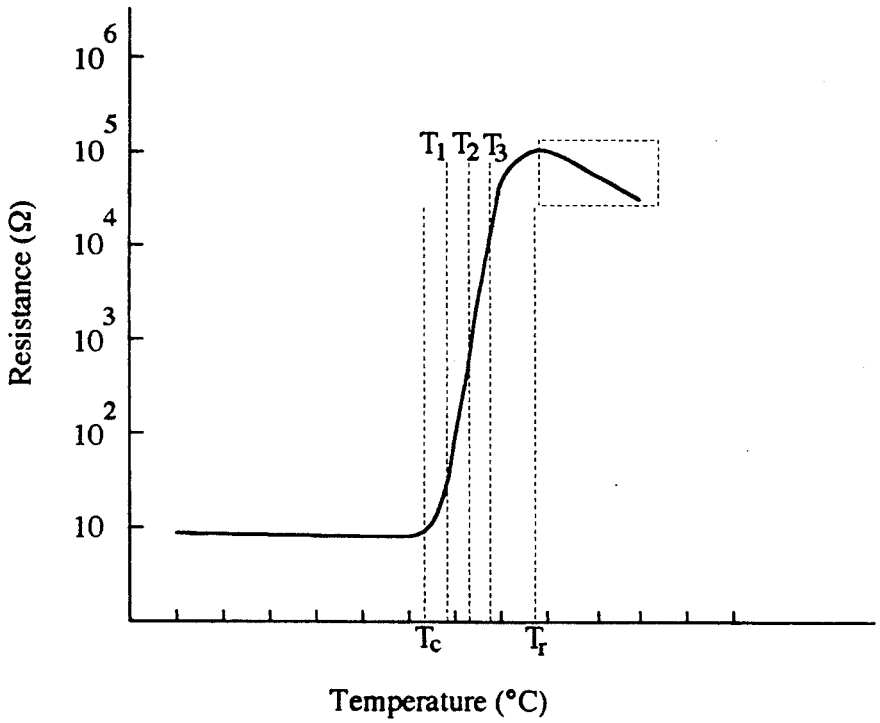
FIG. 1 schematically shows the change of the resistance of a ceramic PTC resistor with respect to the temperature.

During operation, the heat roller is heated by the heat generated by itself. When the heat generating rate exceeds the heat dissipating rate, the temperature increases, for example, in FIG. 1, from $T_1$ to $T_2$, or from $T_2$ to $T_3$, causing a steep increase of resistance due to the PTC effect. The increase of resistance reduces the heat generating rate in an inversely proportional way: the higher the resistance, the lower the heat generating rate, and vice versa. Since the heat generating rate can be decreased to a few thousandths or less of that at room temperature, and the heat dissipating rate is higher at higher temperatures due to the increased efficiency of radiation and convection, the temperature can not reach the run away range (the shaded area in FIG. 1). On the other hand, when the temperature decreases from the operational temperature for any reason, for example from $T_2$ to $T_1$ in FIG. 1, the resistance will decrease steeply, causing a dramatic increase of heat generating rate which increases the temperature very quickly. Therefore the temperature can not stay lower than the operating temperature. This feedback process is performed by the PTC effect of the resistor body automatically and instantaneously, much faster and accurate than the conventional means of heating and temperature regulating, which can not avoid the delays in temperature measuring and heating processes.

In the above-described embodiment of the roller, the structure for transmitting rotational driving force to the roller is by mortise structures and a pin. However it is apparent that other structures can be used to perform the same function.

In the above-described embodiment of the end assemblies (FIG. 4), a pin 11 is provided to transmit rotational driving force from the capping block 10 to the roller body 5. However, it is apparent that other designs of the structure on the capping block, such as a pair of tenons, can perform the same function.

In the above-described embodiment of the roller, the electrically conductive means *7a* and *7b* are disposed upon the inner and outer surfaces of the ceramic body 5. However, it will be apparent to those skilled in the art that these conductive means can be disposed at the ends of the roller if the resistivity of the PTC ceramic material, the geometry of the roller, and the voltage of the electrical power supply permit.

It is apparent for those skilled in the art that numerous modifications and changes can be made within the true spirit and scope of the present invention. It is not desired to limit the present invention to the exact construction and operation described above. It is my intention, however, suitable modifications and equivalents may only be limited by the appended claims.

What is claimed is:

1. A toner image fixing device comprising:

a tubular heat roller having a ceramic body formed of a ceramic resistor material having a positive temperature coefficient of resistance (PTC);

electrically conductive means disposed upon an inner surface and outer surface of said ceramic body, wherein said electrically conductive means provides for electrical connections;

an insulating layer, formed of an electrically insulative and thermally conductive material, disposed upon said electrically conductive means which is disposed upon the outer surface of said ceramic body in order to insulate a sheet carrying a toner image thereon from electrical contact with said electrically conductive means on said outer surface of said ceramic body;

means for rotating said heat roller;

first and second conductive members located at opposite ends of said heat roller which are in electrical contact with said electrically conductive means;

means for applying an electrical voltage to said electrically conductive means by way of electrical connections from an electrical power supply by contacts which press against said first and second conductive members;

said first conductive member electrically contacts said electrically conductive means disposed upon said outer surface of said ceramic body; and said second conductive member electrically contacts said electrically conductive means disposed upon the inner surface of said ceramic body.

* * * * *